United States Patent [19]

Paul et al.

[11] Patent Number: 4,936,262

[45] Date of Patent: Jun. 26, 1990

[54] REGENERATIVE THERMAL ENGINE

[76] Inventors: Marius A. Paul; Ana Paul, both of 1100 E. Orangethorpe Ave., Ste. 140, Anaheim, Calif. 92801

[21] Appl. No.: 352,004

[22] Filed: May 15, 1989

Related U.S. Application Data

[60] Continuation of Ser. No. 286,659, Dec. 19, 1988, abandoned, Division of Ser. No. 805,184, Dec. 5, 1985, Pat. No. 4,791,787.

[51] Int. Cl.[5] ..... F02D 19/00

[52] U.S. Cl. ..... 123/25 C; 123/193 C

[58] Field of Search ..... 123/193 C, 25 A, 25 B, 123/25 C; 60/668

[56] References Cited

U.S. PATENT DOCUMENTS 1,814,781 6/1931 Bailey .
4,070,998 1/1978 Grow ..... 123/26
4,122,803 10/1978 Miller ..... 123/25

FOREIGN PATENT DOCUMENTS 489034 12/1928 Fed. Rep. of Germany .
57-83634 5/1982 Japan .

*Primary Examiner*—Allen M. Ostrager
*Attorney, Agent, or Firm*—Bielen, Peterson & Lampe

[57] ABSTRACT

An internal combustion engine having a cylinder, a piston reciprocally movable in the cylinder, the cylinder and piston defining in part a chamber for combustion, intake means for introducing air into the cylinder at predetermined intervals, exhaust means for removing combustion gases from the cylinder at predetermined intervals, and a regenerator liner in at least a part of the chamber, the liner having a structure with surfaces defining a plurality of regenerative cells constructed to cyclically admit, hold and discharge compressed air from the cylinder for thermally insulating the cylinder from the heat of combustion, the engine including a mechanism to maintain the piston displaced from the cylinder to avoid contact of the piston with the liner and including a positive displacement, rotary compressor-expander to precompress air delivered to the piston cylinder and receive combustion gases from the cylinder to drive the compressor-expander.

22 Claims, 11 Drawing Sheets

REGENERATIVE THERMAL ENGINE

This application is a continuation of Ser. No. 07/286,659, filed Dec. 19. 1988, now abandoned; which application was divisional application of Ser. No. 06/805,184, filed Dec. 5, 1985, now Pat. No. 4,791,787.

BACKGROUND OF THE INVENTION

This invention relates generally to thermal piston engines, and more particularly to structural and conceptional improvements that increase the efficiency of such engines.

The regenerative thermal engine of this invention combines unique components to achieve high efficiencies and low engine weights in compact, structurally and thermally integrated units. The primary object of this invention is to devise adiabatic engines which are capable of operating at high pressures and temperatures utilizing the total expansion of the generated gases without the size and weigh customarily associated with such engines. Further, the use of exotic materials such as ceramics which add to the expense and complexity of such engines is not necessary in the thermal engines devised, enabling a flexibility in the choice of competing materials for construction of highly efficient but low cost engines.

The superior characteristics of the piston engine have numerous application, with both the military and commercial applications in transport and power generation well known. Numerous developmental paths are available for reducing specific fuel consumption,. and for reducing the size and weight of the engine. Many of these paths, however, lead to undersized power plants of high complexity and cost.

In designing a high temperature, adiabatic engine, major problems are involved in selection of materials and design of structures capable of withstanding both high temperatures and pressures. Formulation of systems that can effectively and fully utilize the expanded pressure spectrum without thermal losses, particularly those losses associated with cooling local zones of high temperature, is a major challenge.

In order to effectively utilize the runout thermal energy of the resulting working agent in a compact unit, it is necessary to integrate select components which can most efficiently operate under conditions of low, medium or high pressures. A complete utilization of the thermal energy developed in the combustion process can be accomplished only in the case of an effective harnessing of the total expansion of the combustion gases, from the highest pressure of the cycle of the lowest pressure of the ambient air, exhausting the working gases at the lowest temperature possible.

However, a super-long expansion in the cylinders of a reciprocating piston engine is possible only in very large engines with very low rotations. In such engines as the Sulzer and the Burmmeister and Wain naval engines, in which the ratio of stroke to bore reach 3–4, thermal efficiencies exceed 53%.

In the 720° rotation of the crank shaft during the thermal cycle of a four stroke engine, the evolution of the pressure in the time of the intake, compression, combustion-expansion and exhaust, define various periods of low pressure, medium pressure, and high pressure. The low and medium pressure periods of the cycle cover 80%–90% of the cycle. Only 10%–20% of the cycle or 70% of the 720° of the 720° cycle rotation is associated with the high pressure period of final compression, combustion and initial expansion. Despite the very short duration of the high pressure period (10–20% of cycle time) engines are constructed to withstand this maximum pressure throughout the 720° rotation cycle. The mass of metal and high strength structure is wasted during the rest of the cycle in which only medium and low pressure is encountered. As a result of this factor, actual engines are big, heavy, expensive and inefficient.

In a basic embodiment of an engine capable of effective utilization of the full spectrum of expansion pressures is an integrated rotary-reciprocal compound engine which develops an equivalent compression ratio to the long stroke engines described. The low and medium pressures are developed in the rotary component and include 40% of the cycle in a rotocompressor for compression and 40% in a rotoexpander for expansion. The high pressures are developed in final compression and initial expansion in the reciprocal piston component.

Conventional engines are limited in peak pressures to approximately 150 bars. This level establishes a practical limit for compression ratios including supercharged engines. Thermal efficiency rises with increases in the compression ratio, but the limited peak pressure for conventional engines limits thermal efficiency. Peak pressure is limited in principle by friction, particularly by friction forces associated with the side thrust of the piston against the cylinder liner from the angular oscillation of the connecting rod, and, inertia, particularly inertial forces associated with the increase in size and weight of moving parts designed to accommodate increased peak pressures. These adverse factors have in the past defined the limit of evolution of conventional engines.

The unique engine designs described herein include features that resolve the problems described and enable increased peak pressures to be achieved in compact lightweight engines.

SUMMARY OF THE INVENTION

The engine embodiments described in this invention integrate select designs and components to achieve the conditions for optimizing engine operating parameters. The engine embodiments combine features for adiabatic performance and full spectrum usage of generated high pressures and temperatures for maximum power and minimum weight.

To achieve adiabatic performance, the cylinder walls and, if desired, all the hot surfaces of the combustion chamber are constructed with a regenerative liner comprising a series of angularly disposed fins and air spaces. The air spaces between fins form cells into which compressed air is circulated on the intake stroke and released on the expansion stroke. The piston is displaced from the regenerative liner and sealing is provided by the staggered labyrinth of the fin and air space structure.

Preferably, high peak pressures are achieved by combining a medium pressure, positive displacement rotary component with a high pressure reciprocal component.

The rotary-reciprocal compound engine of this invention accommodates high pressures in a single-cylinder reciprocator component and accommodates medium pressures in a positive-displacement rotary component. Because the regenerative jacket can withstand high temperatures and pressures, it is a preferred component in the high-pressure, high temperature engine embodiments that follows. The reciprocator component includes low mass pistons with short dual connecting rods coupled to counterrotating crank shafts that as a unit eliminate side thrust of the piston and hence the thrust associated friction of conventional engines. The result is a small component which provides rotary compression and expansion for 80–90% of the total engine displacement and reciprocal compression and expansion for 10–20% of the engine displacement. The reciprocator and rotor are interconnected by a gear box with a transmission ratio adapted for optimum volumetric efficiency.

The rotary-reciprocal compound engine in one embodiment is characterized by a monocylinder having a single piston connected to two splayed connecting rods each connected to a separate crankshaft in combination with a positive rotary compressor-expander of a screw type or epitrochoidal type similar to a Wankel engine. This embodiment defines a three stage pressure evolution with a low pressure, rotocompressor stage, a high pressure reciprocator stage, and a medium pressure rotoexpander stage. The total thermal cycle of such engine defines a superlong compression-expansion cycle characterized by a very high efficiency.

A similar embodiment is constructed with a reciprocator component having an efficient uniflow scavenging process in a single cylinder with opposed pistons, each piston similarly connected to two connecting rods and counter-rotating, crank shaft mechanisms.

Intergrating a Comprex® pressure wave converter between the rotor component and the reciprocator component, or between the reciprocator component and another expander further enhances the efficiency.

For a super power regime, the excess air existing in the combustion gases from the reciprocator component can be used in an afterburner chamber in which the working fluid can be reheated and further expanded in subsequent stages of the engine.

Finally in a wholly integrated system of a rotary-reciprocal, compound engine a thermoenergetic cascade can be developed from selectively connecting or disconnecting the following components:

low pressure rotocompressor
high pressure reciprocator
medium pressure rotoexpander
intercombustion chambers
Comprex wave converters
intercooler and recuperators
turbocharger The thermoenergetic cascade can operate partially, energetically based on an intercombustion chamber producing combustion gases only for the rotary component with the reciprocator component disconnected. Similarly the cascade can operate partially, energetically based on the reciprocator component with the rotary component disconnected.

By use of a compound rotary-reciprocal engine, peak pressures can be raised from 150 atm to 180 or 200 atm. Because of the extremely high combustion temperatures involved, the cylinder chamber of the reciprocator component preferably utilizes the recuperative regenerator previously described to achieve adiabatic engine performance.

These and other features will become apparent from a consideration of the various exemplar embodiments shown in the drawings and described in the detailed description of the preferred embodiments.

DETAILED DESCRIPTION OF THE PREFERRED EMBODIMENTS

The thermal engines of this invention utilize several novel components in various combinations to achieve superior performance. When the various components are integrated into the ultimate rotary-reciprocal compound engine designs described, peak pressures and temperatures heretofore unachievable in a reciprocal engine are developed. The combined components form a unit with a staged expansion to recover maximum work for improved engine efficiencies.

Figure 1:
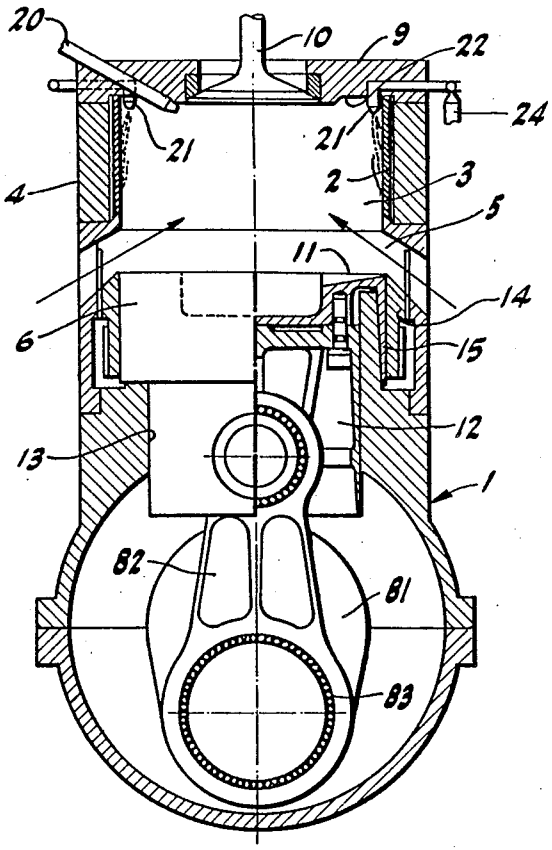
FIG. 1 is a cross sectional view, partially fragmented of a reciprocal engine with a regenerator lining.

Referring to FIG. 1, a reciprocal engine 1 is shown with a unique piston and cylinder arrangement to enable use of a novel cylinder liner 2 for the combustion chamber. The liner 2 forms a regenerative jacket which receives and releases compressed air during the engine cycle to dynamically insulate the walls of the cylinder 3. In FIG. 1, an outer engine block 4 is constructed with a working cylinder 3 and a piston 6 reciprocal in the cylinder 3. The piston 6 is connected to a conventional connecting rod 7 and crank 8. A conventional head 9 and monovalve assembly 10 (shown in part) cap the cylinder 3.

The block has peripheral air intake ports 5 which are exposed when the piston 6 is in the retracted position shown. Combustion gases exhaust through the monovalve assembly, which with additional valving may supplement air intake at an appropriate time in a preferred two-cycle operation of the engine.

The piston is of differential design having an enlarged cap 11 coupled to a central cross-head 12 which is guided in a low temperature guide cylinder 13 in the block 4. The size of the scavenging ports at the base of the combustion chamber 3 are controlled by a sliding valve 14 which can completely close the ports for operation of the engine in a four stroke mode.

The enlarged cap 11 is fabricated from a strong, high temperature tolerant material such as stainless steel. The cap 11 is constructed with a depending lip 15 that overlaps a projection of the guide cylinder 13 to form a complex sealing passage during the down stroke. In the up stroke the piston cap never contacts the novel cylinder liner 2, which is construction with a series of fins 16 and grooves 17 as shown in the enlarged fragmentary view of FIG. 2.

The cylinder liner 2 is a regenerative cell system that in part functions as a staggered labyrinth sealing system and in part as a thermal regenerator.

In its functions as a thermal regenerator, the liner or regenerative jacket 2 operates by a process based on the penetration, intake and compression inside the cells 18 of freshly cooled, high pressure air, supplied by an intercooled supercharging system (not shown) during the scavenging process.

In the compression stroke, a part of this air is accumulated and pressurized inside the regenerator cells 18, formed as the piston passes the grooves 17 between the fins 16. The rising piston 6 creates a pressure wave that is increasing. Low pressure admission air in the chamber is forced into the cells of the regenerator. Because each cell has an incrementally increasing pressure, leakage by the advancing edge of the piston is soon absorbed by a lower cell in the pressure cascade. The trapped air absorbs the thermal energy accumulated in the walls of the regenerator jacket from the previous power stroke. The accumulated compressed and heated air in the cells 18 forms an active counter-pressure against the combustion gases escaping during the power stroke.

At the same time in the expansion stroke, the compressed air accumulated inside the cells 18 expands toward the cylinder space, generating a dynamic, concentric-radial and centripetal flow, which forms am envelope of air surrounding the hot gases, creating a pneumatic insulation between the hot gases and the walls. The heat radiated from the hot gases is in general the principal source of heat transfer to the cylinder walls. Another effect, perhaps the most important, is the expansion of the compressed air, which on being further heated posses a higher enthalpy, thereby recovering the energy accumulated in the regenerated cell system.

This compressed and preheated air is an ideal additive to the combustion process. The air is supplied from the walls of the working cylinder 3 in the final stage of combustion when the concentration of oxygen is reduced. The radial injection of the air to the combustion gases has an additional turbulent effect for aiding complete combustion.

Finally, the air and the regenerative cells together form an ideal insulation and an adiabatic shield against the transfer of thermal energy which is normally lost through the cooling system.

Because the piston 6 is a perfect cylindrical body, without contact with the hot wall zone of the cylinder, lubrication and oil can be completely avoided, including all associated mechanical losses. The piston is guided in the bottom zone of the cylinder, which is a conventional cylinder liner. The bottom zone is lubricated by an air and solid suspension, composed of micro-particulates of graphite and MOS2 (which are injected between the contact surfaces). The same air and solid micro-particulate suspension is injected into all of the roller bearings, assuring lubrication and removal of the heat generated in the bearings.

The recollection of the micro-particulates is assured by a group of auxiliary cyclone traps (not shown). The air that is partially expanded and heated by this process is returned to the intercooler of the high stage supercharger for recompression to a final pressure. Alternately, the bottom zone of the cylinder and bearings can be lubricated by conventional means.

In the exemplar of FIG. 1, the engine is a high temperature fuel injected engine with a conventional fuel injector 20 and with unique auxiliary liquid injection nozzles 21 for adding an injected cooling fuel or water in a thermal cogeneration process.

Figure 2:
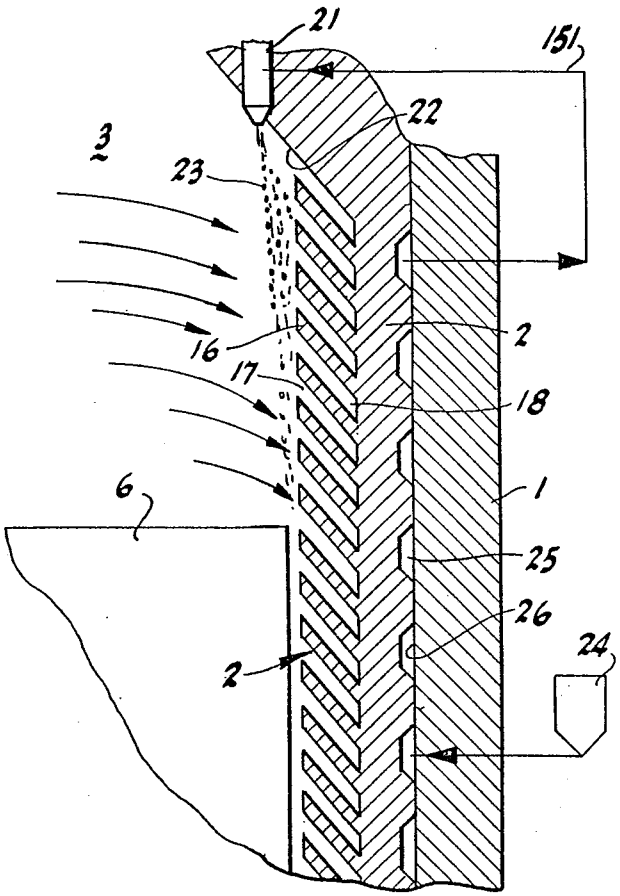
FIG. 2 is an enlarged partial cross sectional view of the regenerator lining for the combustion chamber of the engines disclosed.

In all the applications of the regenerative jacket 2 a cogeneration thermal process may be added. This process injects a cooling fluid (methanol, liquid NO2, liquified gases, or water) through an injection system which comprises a series of spaced nozzles 21 around the crown 22 of the combustion chamber which direct an arcuate spray 23 down the walls of the regenerator during the brief period that the piston is rising in its compression stroke. A liquid injector 24 feeds the nozzles with liquid, usually water in a measured timed pulse. Preferably, as shown in FIG. 2, the liquid is preheated by circulating in a helicoidal passageway 25 between the regenerative jacket or liner 2 and the wall 26 of the block 1.

In embodiments employing a cogenerator using water injection, the fine droplets of water in the spray are directed at the walls of the regenerator and are swept into the cells with the packing air. The high velocity spray mist is drawn into the regenerative cells which cover the walls of the combustion chamber by action of the increasing chamber pressure as the piston rises.

In the cells the water is vaporized cooling the fins and the vaporized water is released as superheated steam along with the compressed air during the power stroke thereby confining the peak temperature gases of the combustion at the center of the chamber.

The heating, evaporating and the super-heating process is accomplished in the brief time in which the piston is near the top dead point. The flushing of this superheated steam or additional combusted cooling fluid after the peak combustion time occurs as an admixture to the regular combustion gases as the piston descends. In the case of steam, there is associated a Rankine cycle with the regenerative, thermal cycle. The homogeneous mixture of combustion gases, superheated steam, and the preheated air expanded from the regenerative cells, comprises the final working fluid that drives the piston and any exhaust-powered, auxiliary or integrated component as described with relation to the other engine embodiments.

Figure 3:
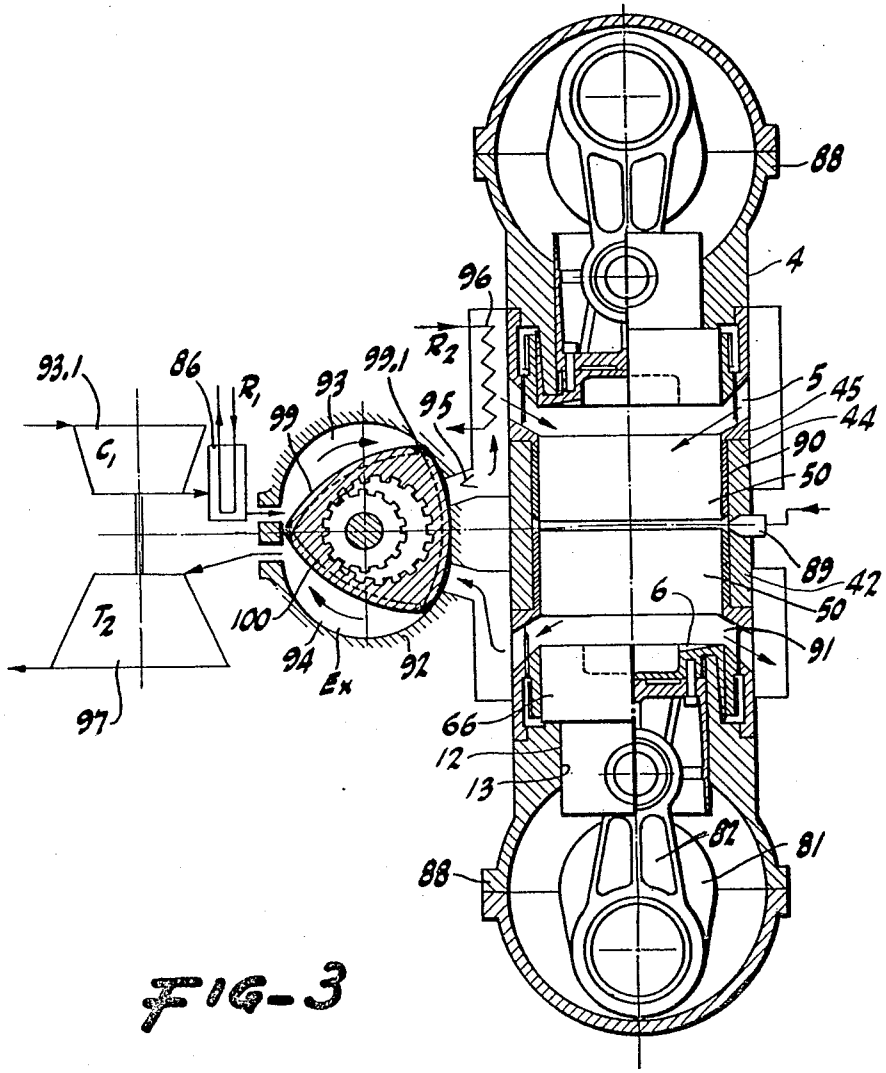
FIG. 3 is a cross sectional view of a compound rotary-reciprocal engine with an opposed piston reciprocator unit and a supercharger.

Referring to the engine embodiment of FIG. 3, the regenerative thermal engine shown comprises a rotary-reciprocal compound engine with a two stroke, opposed piston component 88 coupled to a rotary piston component 92. The compound engine includes a turbocharger 97 and two intercoolers 96 and 98 between the air compression stages.

The opposed piston arrangement of the reciprocator component 88 is similar in construction to the engine embodiment of FIG. 1. Opposed differential pistons 6 drive two crank shafts 81 coupled to the pistons by connecting rods 82. Replacing the head and valve assembly of the FIG. 1 embodiment is a simple side mounted fuel injector 89. A compound liner 42 includes a central segment 44 comprising the regenerator 2 and end segments 45 forming scavenging ports 5 and exhaust ports 91.

The rotary piston component 92 is a roto-compound system composed of a compressor stage 93 and an expander stage 94. The compressor stage 93 receives precompressed air from the compressor side of the turbocharger 97, which is cooled by the intercooler 98. The precompressed and cooled air is further compressed by the positive displacement compressor stage of the rotary component 92. After cooling by the second intercooler 96, the compressed air passes flap valve 95 and enters the reciprocator component 88 through intake ports 5. The entering air under medium compression is further compressed by the united compression stroke of the two opposed pistons 6 to a substantially higher than usual compression. Fuel injected through an injector 89 ignites in the small core chamber between the piston heads and generates the extremely high pressures herebefore unattainable in piston engines. Because the single combustion chamber is centralized, stresses are localized and confined to a cylindrical structure, a configuration best able to withstand the extraordinary high pressures generated.

The piston cap 11 is of special construction and fabricated from a high strength material such as stainless steel, and is coupled to the central cross-head 12 which reciprocates in the low temperature cylinder guide 13 of the engine block 4. The short connecting rods 82 and heavy duty cranks 81 absorb the high energy thrust of the pistons 40 and enable a high torque, high r.p.m. operation. Cooling of the cylinder walls by the regenerator is accomplished as explained with reference to FIGS. 1 and 2. The expanding combustion gases exhaust through ports 91 and enter the expander stage 94 of the roto-compound system powering the rotary component 92.

The positive displacement rotary component 92 is an epitrochoidal-type engine similar in type to the Wankel engine. While it has certain attributes of relative efficiency due to its low inertia, rotary operation, it is not effective at high pressures and temperatures because of sealing problems. However, it is ideally suited to accept the partially expanded gases from the high pressure reciprocator component because of its volumetric efficiency. The rotary component is coupled to the reciprocator component in the proper ratio of rotation for a volumetric exchange that assures a high pressure ratio for the supercharging and a high expander ratio for exhaust gases.

The rotary component 92 is provided with a ceramic or an insulated rotative piston 99 and is lubricated and cooled by a graphite/MoS2 dry lubricant supplied pneumatically, to the gear and bearing mechanism. The absence of oil and friction between the rotor, piston and the epitrochoidal case prevents any excessive wear at high rotational speeds. Sealing is assured by auto adjusting material of Teflon ® type impregnated with graphite and MoS2 on the tips 99.1 of the triangular rotary piston 99. The same material is provided for the lateral sealing 100.

As noted in the summary of the invention, the unification of the medium pressure rotary component with the high pressure reciprocator component enables a high peak pressure to be developed with only the engine structure in the high pressure zone being necessarily designed to withstand such high peak pressures. This intimate integration enables a substantial reduction in engine size and weight to achieve a desired power output.

Figure 4:
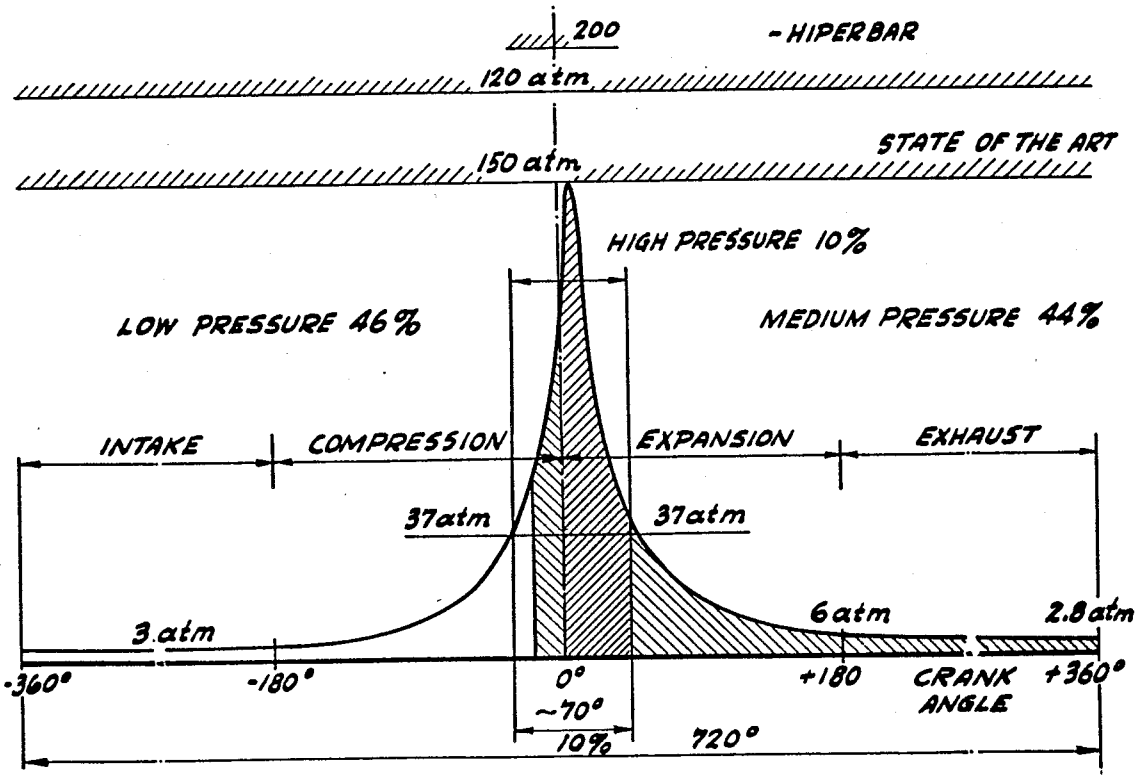
FIG. 4 is a schematic view of a typical pressure curve for a four stroke engine.

FIG. 4 is a schematic illustration of the typical pressure curve over a 720° crank shaft rotation in a four stroke engine. As illustrated only a small band of 70° is associated with pressure exceeding 37 atm and over half of the remaining cycle pressure is less than 6 atm. By staging the components in an integrated unit that is volumetrically balanced, with each component constructed to withstand those pressures and temperatures within its operating range, a boost in the peak pressure can be obtained at the same time a reduction in size and weight is accomplished. For example, a low pressure range can be efficiently handled by a supercharger, a medium pressure range by a positive displacement rotary device, and the high pressure range handled by a specially designed reciprocal device. An efficient thermoenergetical cascade following the pressure curve can be developed by an integrated engine incorporating these exemplar devices.

Figure 5:
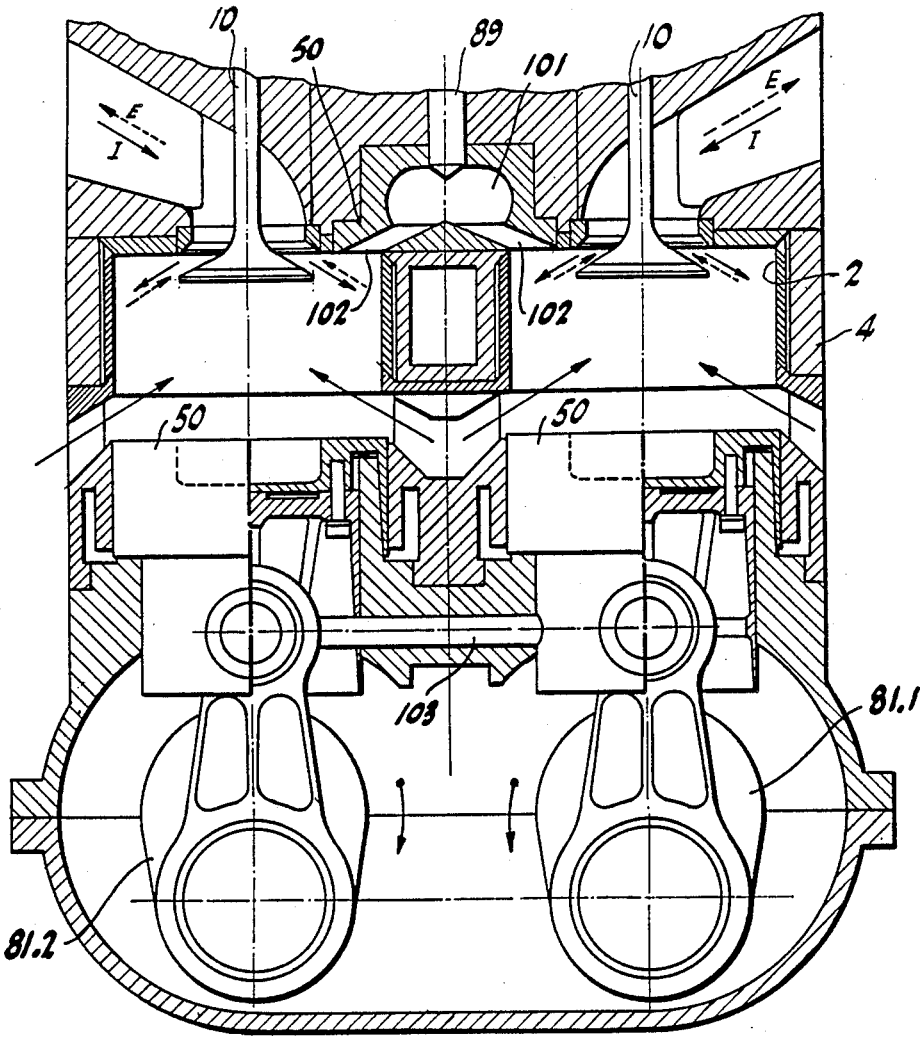
FIG. 5 is a cross sectional view of an embodiment of the combustion and drive section of a convertible 2 to 4 stroke engine with dual interconnected pistons and a connected combustion chamber.

In the FIG. 5 embodiment, the regenerative thermal engine shown is a convertible four and two stroke device having, a twin arrangement of pistons 50 with permanent dynamic balance. The pistons have a common and symmetrical cycle, by the fact that they are provided with a central, common combustion chamber 101, connected with two tangential channels 102 to cylinders. The two piston mechanisms are connected by a strap 103, which takes the opposed side thrust produced by the two counter-rotating crankshafts 81.1 and 81.2. Both counter-rotating crankshafts are geared outside in a 1/1 ratio, assuring perfect symmetry and synchronism of both movements.

This arrangement totally avoids any side thrust between the piston and the cylinder walls, excluding a major source of mechanical losses, and allows a close tolerance to be maintained between the pistons 50 and the regenerator 2.

Figure 6:
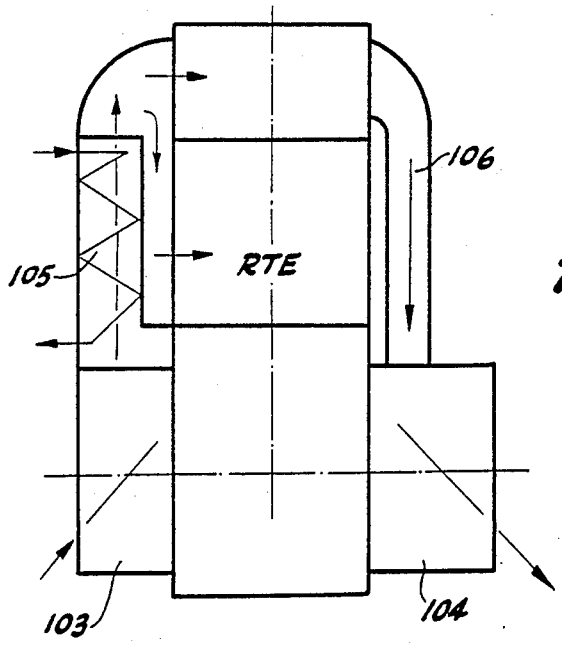
FIG. 6 is a schematic view of a compound reciprocal rotary screw engine.

In the schematic view of FIG. 6, the regenerative thermal engine of FIG. 5 is associated with a conventional screw compressor 103 and a screwexpander 104, connected directly on both crankshafts of the mechanism in permanent dynamic balance. The counter rotating shafts of the balanced crank mechanism are ideal for a compound screw device of the type made by Lisholm.

The high compressed air is inter-cooled in a heat exchanger 105, and the exhaust gases are transported through the pipe 106 from the cylinder head to the screwexpander 104.

The screwexpander 104, is provided with ceramic counter-rotating rotors and sealed by auto-adjusting elements made from Teflon® impregnated with graphite+MoS2.

Figure 7:
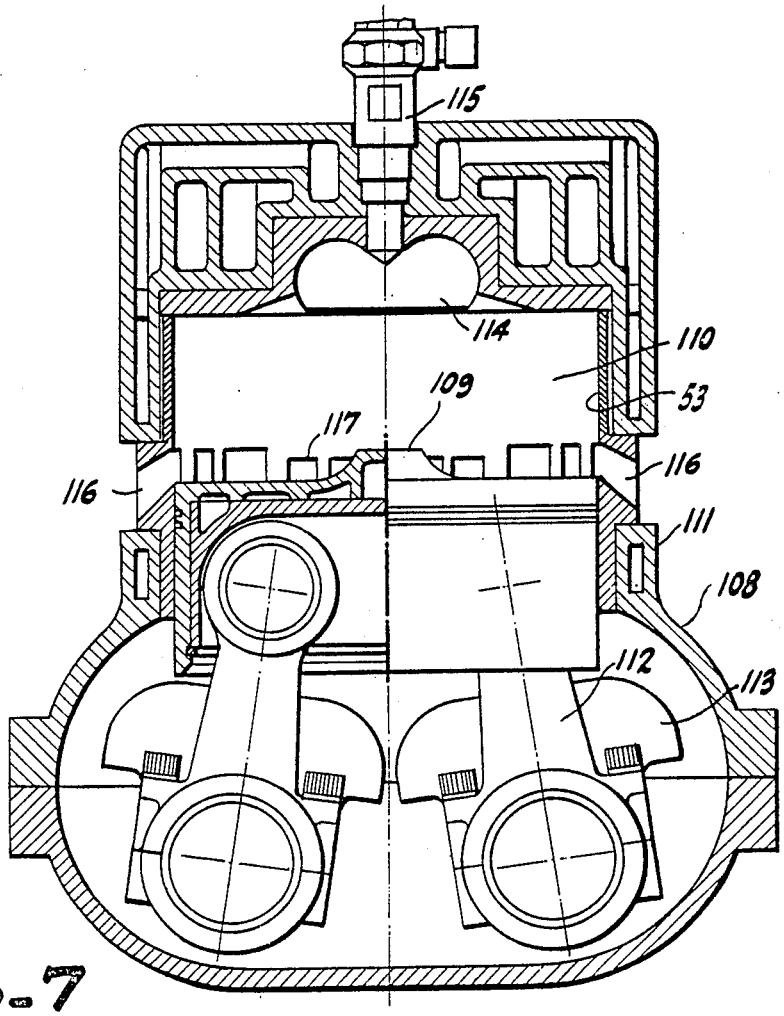
FIG. 7 is a cross sectional view of the combustion and drive section of a single piston, dual crank engine component.
Figure 8:
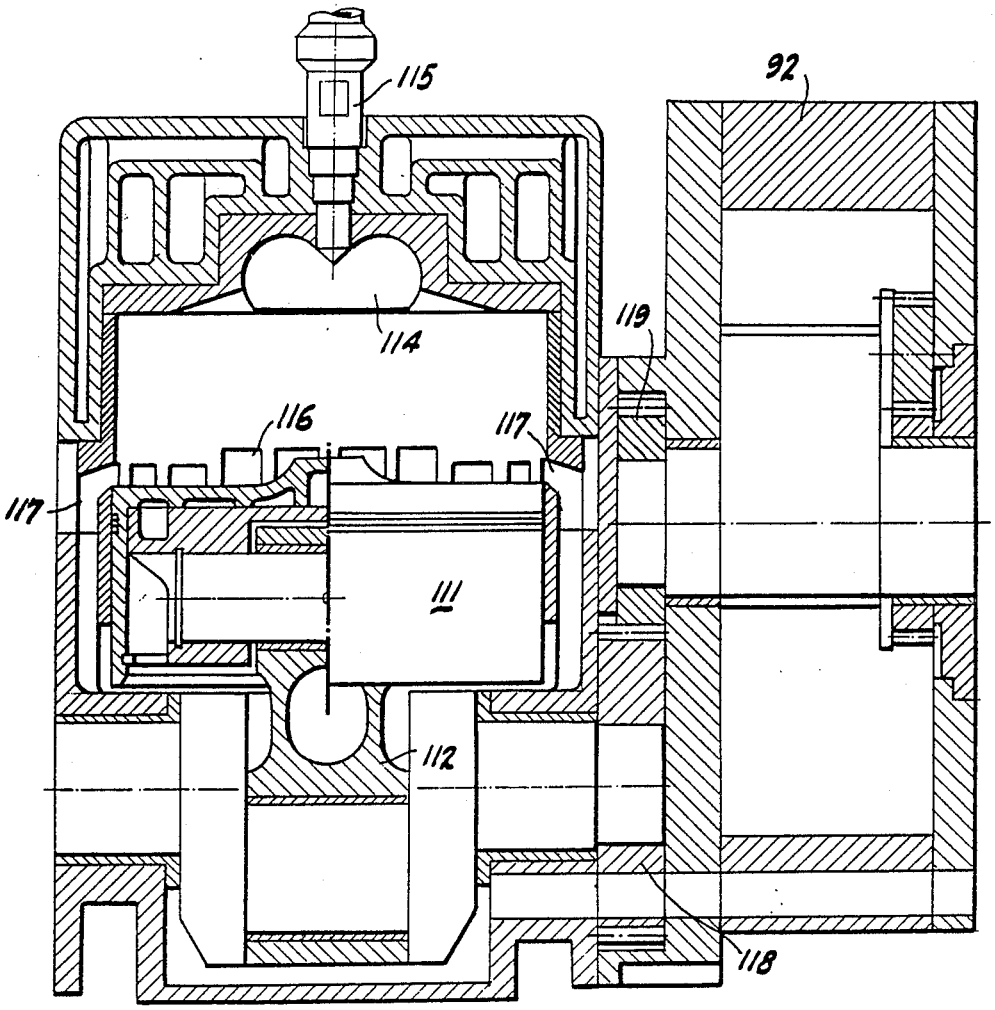
FIG. 8 is a cross sectional view of the engine component of FIG. 7 in combination with a rotary component.

Referring to FIGS. 7 and 8 the concepts for balanced engine operation disclosed with reference to FIG. 5, are combined in an advanced compound, rotary-reciprocal engine 108. While the engine embodiment of FIGS. 7 and 8 and the subsequent advanced design embodiments are particularly devised to incorporate the regenerator liner disclosed herein (since such designs advantageously eliminate piston side thrust) the constructions have independent merit and may incorporate other exotic liners, particularly liners demanding that piston and cylinder wall contact be wholly eliminated. The following embodiments, particularly the schematic arrangements disclosed in FIGS. 12–17, disclose variations of integrated components that are configured to achieve a thermal energetical cascade following as closely as practicable idealized pressure curves of the type described with reference to the schematically illustrated curve of FIG. 4, but with substantially elevated peak pressures and temperatures.

Figure 12:
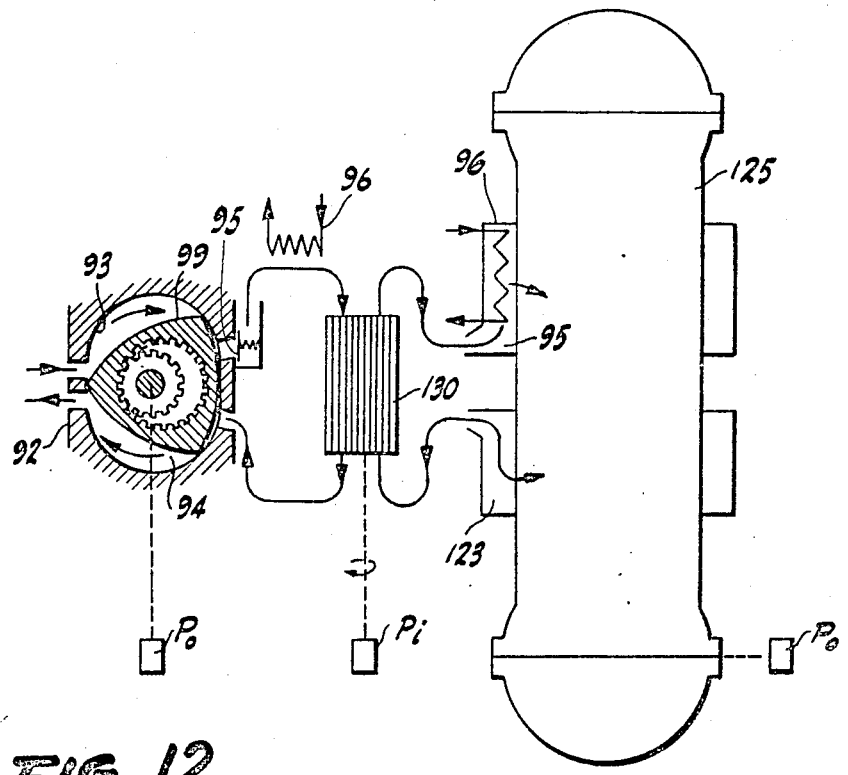
FIG. 12 is a schematic illustration of a compound rotary-reciprocal engine with an intermediate pressure wave supercharger.

In a compound rotary-reciprocal engine of FIG. 12 a single cylinder 110 contains a single reciprocating piston 111. While the piston is shown with external grooves 107 for labyrinth sealing or ring sealing in conjunction with a high temperature cylinder liner 53, it is to be understood that the combustion chamber design is particularly suited for incorporation of the regenerator liner 2 as hereinabefore described.

The large bore, short stroke reciprocator component of the compound engine is designed for high pressures and includes two connecting rods 112 connecting the single piston 111 to two counterrotating, balanced crank shafts 113. The single cylinder 110 has a torrodial adiabatic combustion chamber 114 with a central fuel injector 115. The cylinder has staggered exhaust ports 116 and scavenging ports 117.

The counter-rotating gears interconnect the two crankshafts in a symmetrical and synchronous movement. The offset intermediate gear 119, engaging one of the crankshaft gears, integrates the rotary component with the reciprocator component. As shown in FIG. 8, the epitrochoidal compressor-expander 92 is integrally coupled to the reciprocator component. The compressor-expander 92 supplies the combusted chamber of the reciprocal pistons with compressed air, and is simultaneously driven by the partially expanded exhaust gases in the manner previously described.

Figure 9:
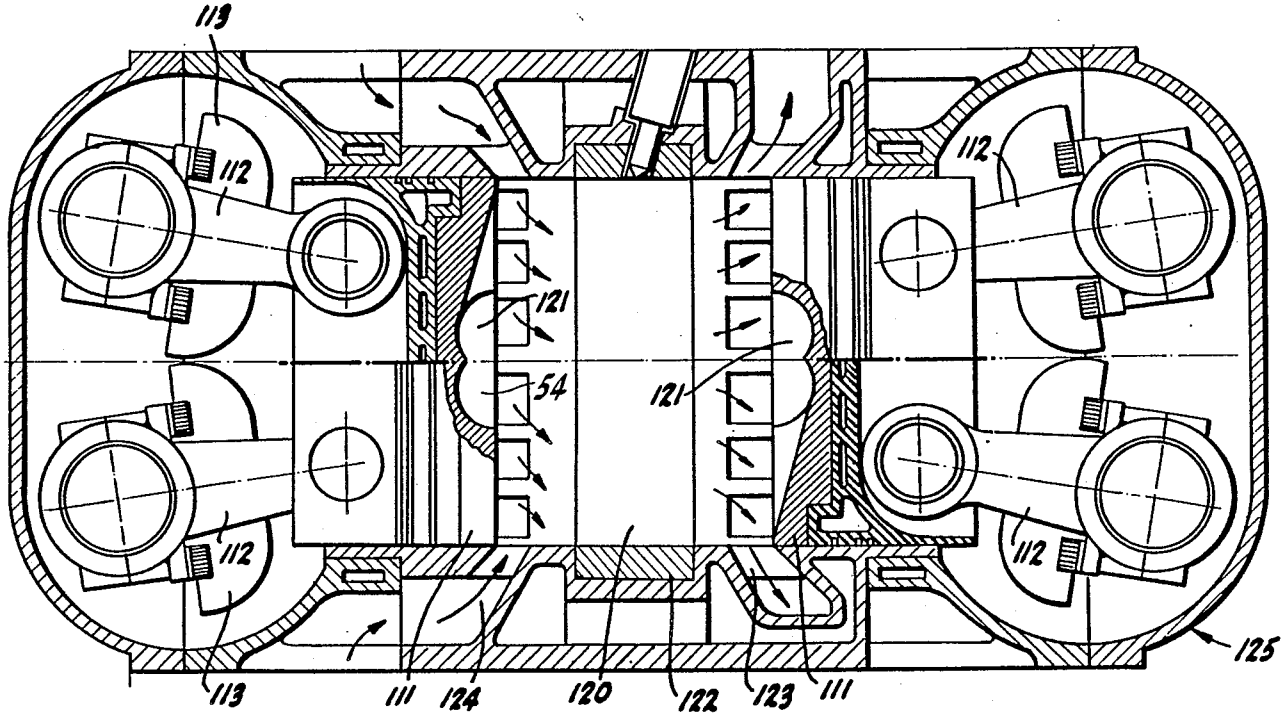
FIG. 9 is a cross sectional view of the combustion and drive section of an opposed piston dual crank engine component.

Referring to the engine embodiment of FIG. 9 a super compact, high pressure reciprocator component 125 is shown. Utilizing the dual rod concept of the embodiment of FIGS. 7 and 8, an opposed piston, single chamber reciprocator is formed with the large bore, short stroke features of the prior embodiment. In this embodiment opposed pistons are arranged in a single combustion chamber 120 with a central liner 122 that preferably is an adiabatic regenerator 2 of the type described. At opposed ends of the combustion chamber are exhaust ports 123 and scavenging ports 124. The dual pistons 111 each have a specially formulated adiabatic cap 121 that preferably comprises a regenerator with cell means such as a micropore structure for absorbing and releasing compressed air and/or pass through liquids and vapors for surface cooling of the piston cap 121 and the preignition chamber 54 formed by the recessed contour in the cap.

Because the engine embodiment of FIG. 9 is most effectively operable as extremely high pressures, it is primarily suited as a high-pressure-range component to a compound engine, particularly one integrating a rotary component such as the screw of FIG. 6 or preferably the roto-compressor expander of FIGS. 3 and 8.

Figure 10:
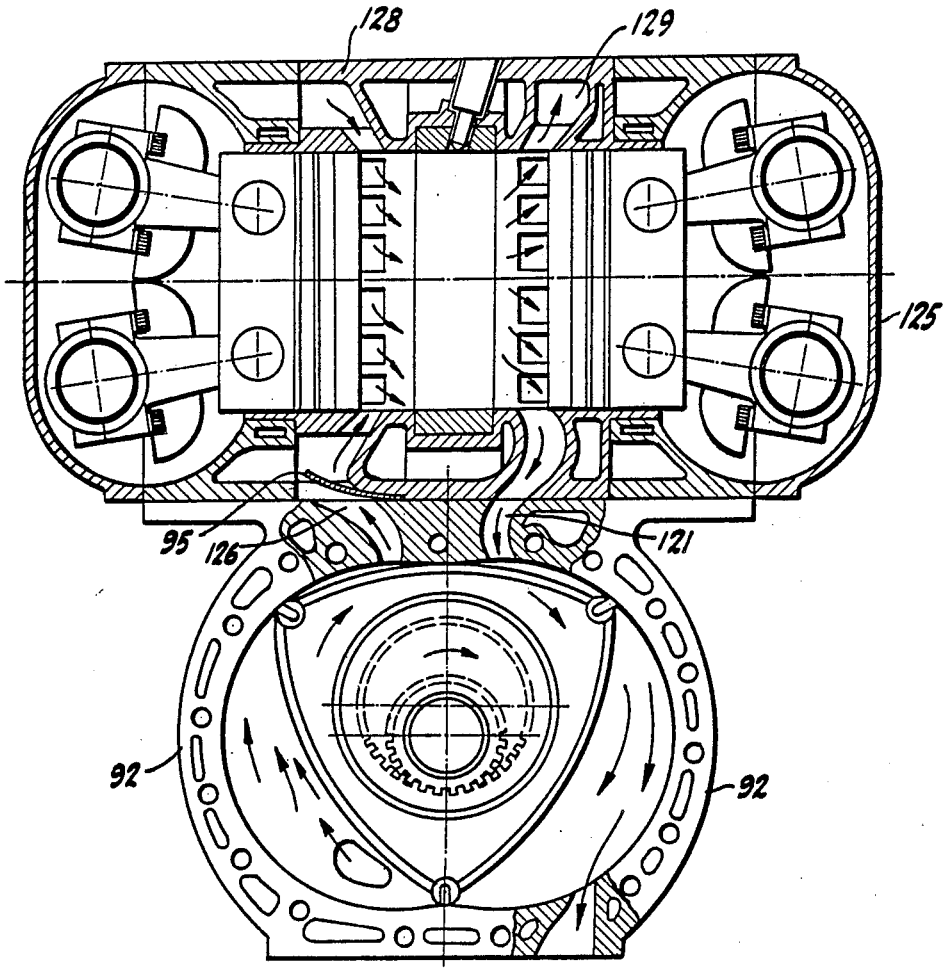
FIG. 10 is a cross sectional view of the engine component of FIG. 9 in combination with a rotary component.

One arrangement of this compact engine unit is show in FIG. 10 which is particularly sized and adapted for use for general applications, where the output shafts can be connected to an appropriate gear box or transmission for separate independent operation. The connection of the reciprocator component 125 above the rotary component 92 is convenient for efficient gas flow, particularly where additional intermediate or auxiliary components are combined to enhance the basic unit. The direct connection connects the compressed air exit port 126 and the combusted gas intake port 127 of the rotary component 92 with the respective intake manifold 128 and exhaust manifold 129 of the reciprocator component 125. A metallic flap valve 95 insures one way passage of compressed gases.

Figure 11:
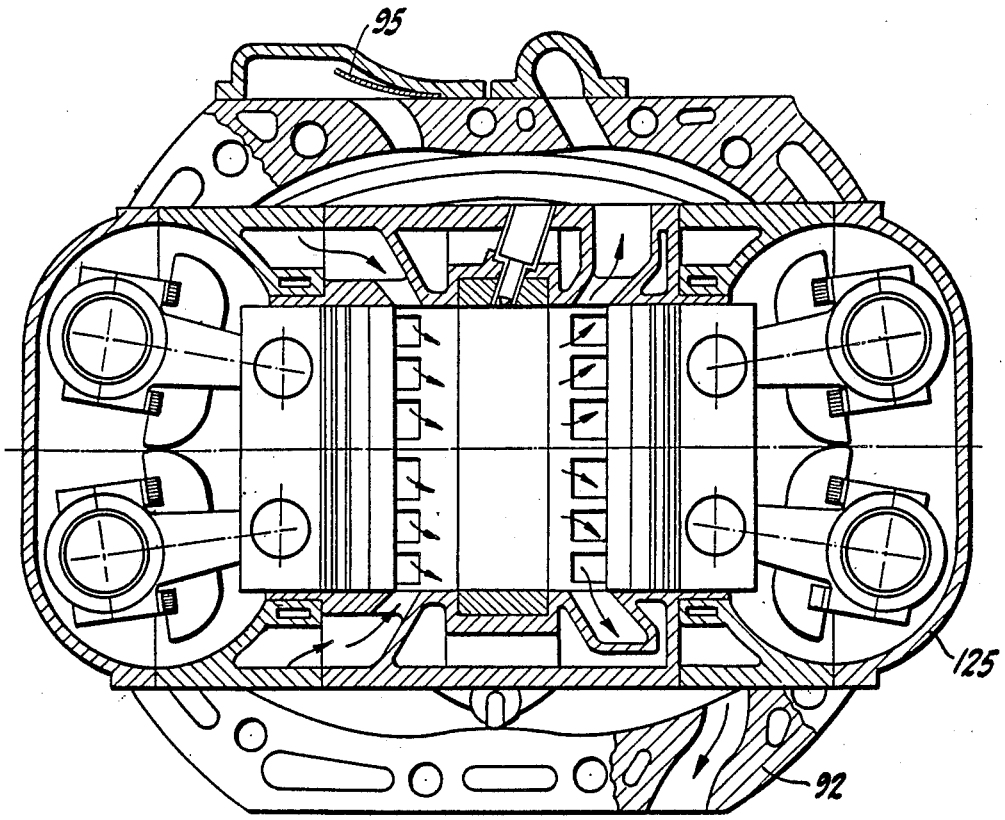
FIG. 11 is a cross sectional view of an alternate arrangement of the engine component of FIG. 9 in combination with a rotary component.

A second arrangement of the compact engine is the front and back positioning shown in FIG. 11. The enlarged rotary component 92 with respect to the reciprocator component 125 is particularly useful in reduced atmosphere conditions or where low pressure turbocharging is restricted.

The basic unit of the compound rotary-reciprocal engine can as noted include enhancements to enhance efficiency as illustrated in the schematic illustrations of the FIGS. 12–17.

In the schematic of FIG.. 12 the reciprocator component 125 has an intervening connection with the rotary component 92. The pressure wave supercharger 130 provides additional compression to the air from the rotary component before entry to the reciprocator component and has a tendency to buffer or smooth pressure pulsing from the periodic positive displacement cycling of both the reciprocal and rotary components. The compression side has intercoolers 96 between the rotary component and the supercharger and the reciprocator component. While the particular design of the reciprocator component is the unit of FIG. 11, including the regenerator liners, the combination is intended to include such engine component without exotic liners or other such engine components disclosed herein with reference to this or the following figures. Similarly, the rotary component shown is identified as the epihoitroidal type, but described herein, but may also comprise the compound screw compressor-expander previously described or other positive displacement rotary compressor expander of the type disclosed.

Figure 13:
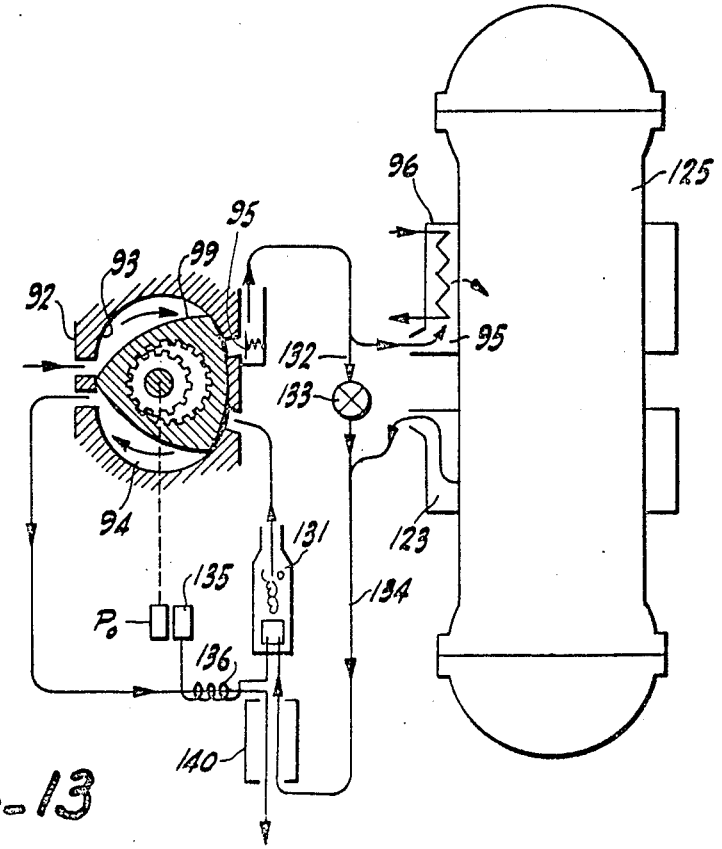
FIG. 13 is a schematic illustration of a compound rotary-reciprocal with an intermediate intercombuster.

In the schematic of FIG. 13, the reciprocator component 125 is connected to the rotary component 92 with an intervening intercombustion chamber 131 with a compressed air by-pass circuit 132 with a control valve 133 for regulating supplemental air to the intercombustion chamber 131. A thermal recuperator 140, insures that the added thermal energy to the exhaust gases is recovered in the air-gas supply 134. The fuel supply 135 may also include a preheater 136 to recover waste energy of the exhaust.

Figure 14:
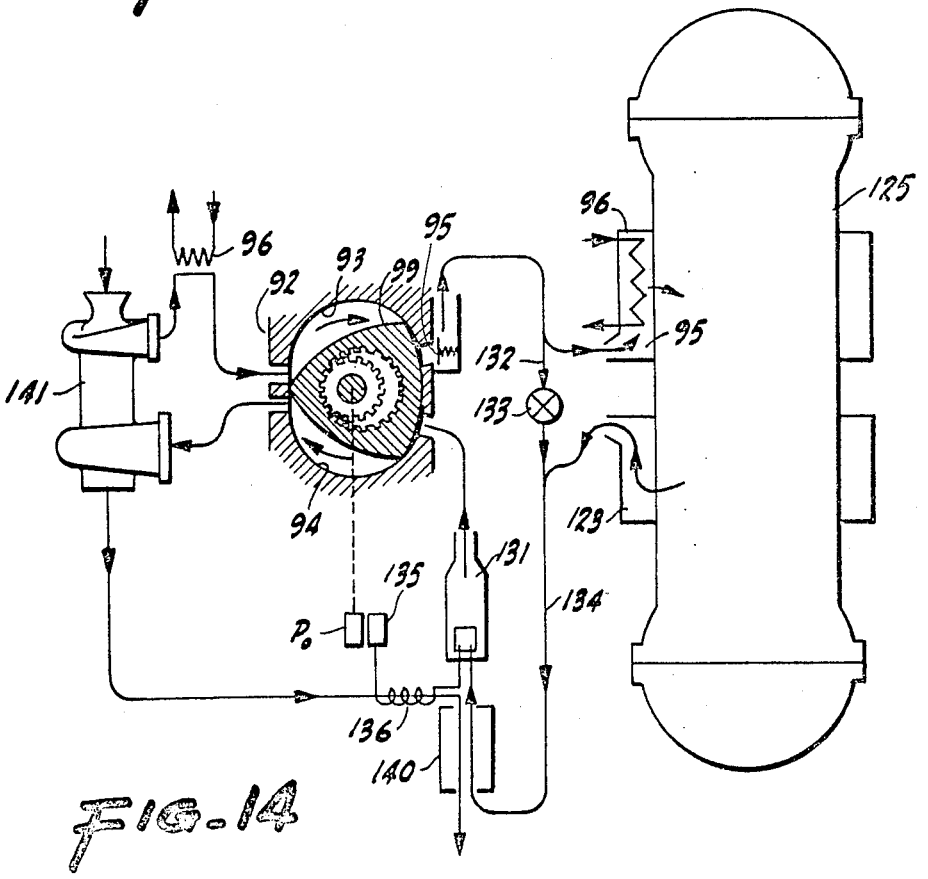
FIG. 14 is a schematic illustration of a compound rotary-reciprocal engine with an intermediate intercombuster and auxiliary turbocharger.

In the schematic of FIG. 14, a turbocharger 141 has been added to the thermodynamic cascade of the arrangement of FIG. 13. The turbocharger effectively utilizes the low pressure expansion gases prior to exhaust through recuperator 140, to perform low end compression of the intake of air. An intercooler 96 is similarly provided to the compressed air to reduce the volume and temperature added by the compression.

Figure 15:
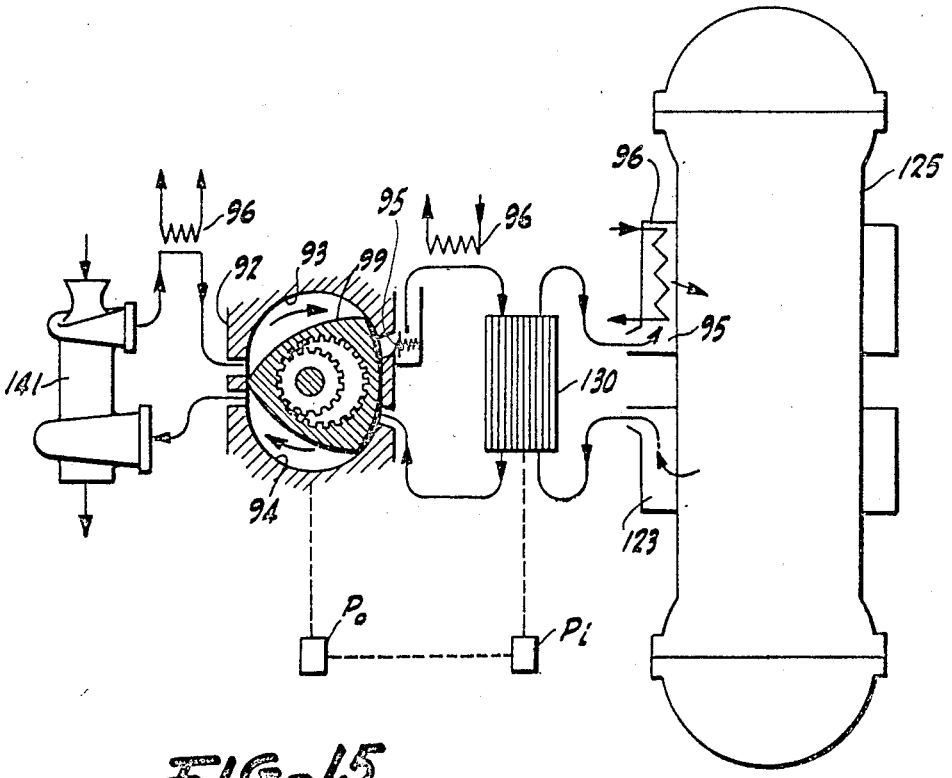
FIG. 15 is a schematic illustration of a compound rotary-reciprocal engine with an intermediate pressure wave supercharger and auxiliary turbocharger.

In the schematic of FIG. 15, a Comprex® pressure wave supercharger 130 has been installed between the reciprocator component 125 and the rotary component 92 essentially combining the arrangements of FIG. 12 and FIG. 14 without the intercombustor.

Figure 16:
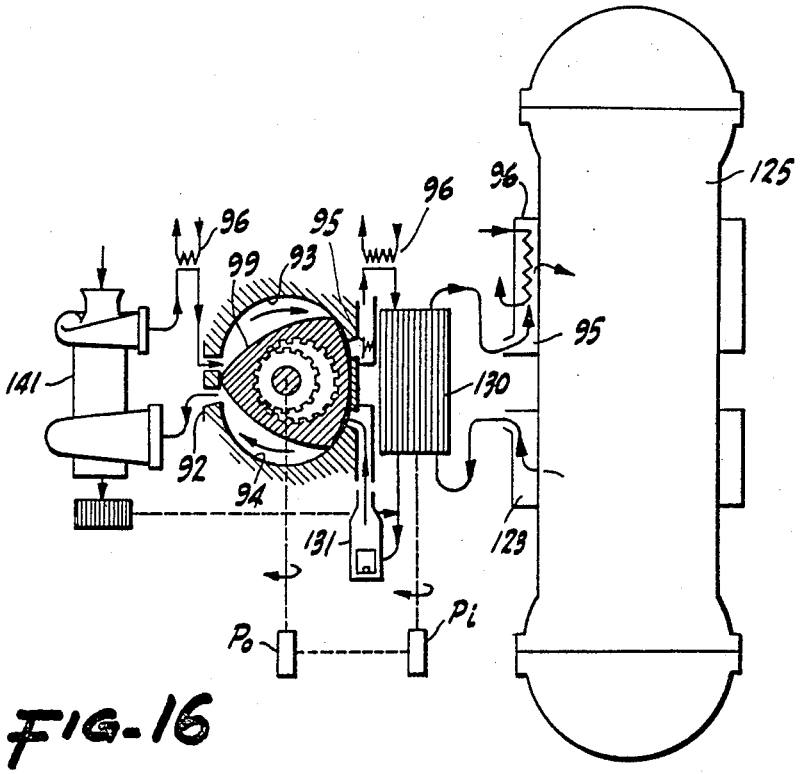
FIG. 16 is a schematic illustration of a compound rotary-reciprocal engine with an intermediate pressure wave supercharger, intercombuster and an auxiliary turbocharger.

In the schematic of FIG. 16 the intercombuster has been added, which is a bypass circuit 143 that allows use of the rotary component or the reciprocator component independent of the other.

Figure 17:
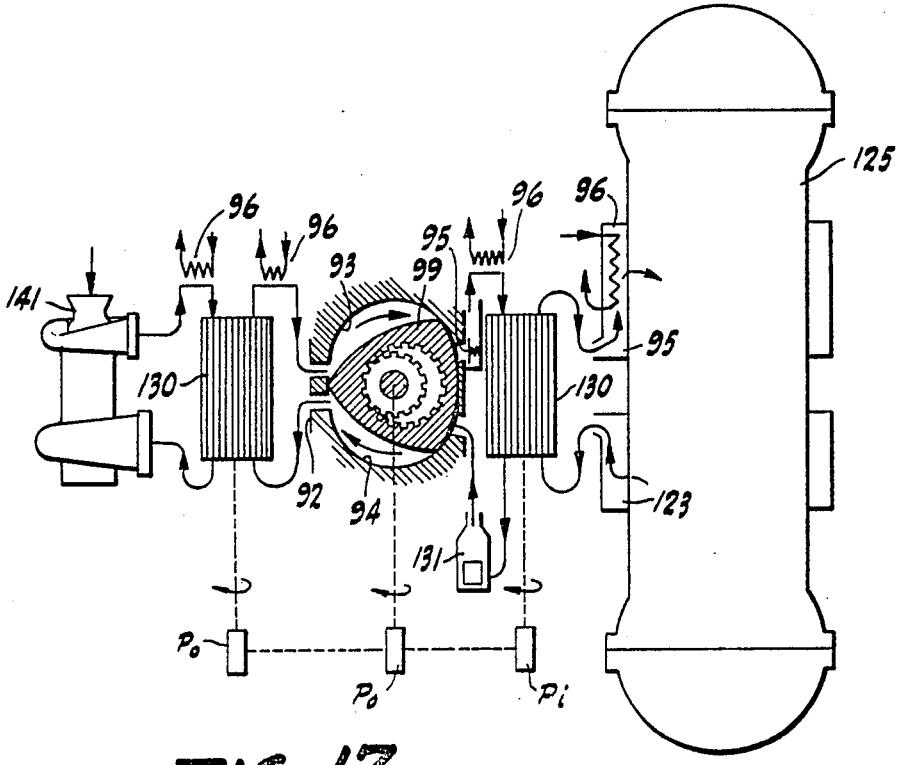
FIG. 17 is a schematic illustration of a compound rotary-reciprocal engine with an intermediate pressure wave supercharger, intercombuster, auxiliary pressure wave supercharger and turbocharger.

In the schematic of FIG. 17 an additional pressure wave supercharger 130 has been installed between the turbocharger 141 and the positive displacement rotary component 92 to boost compression and smooth the pressure pulsing of the rotary component 92. Power for driving the wave guide supercharger 130 are extracted from the combined output drive train of the rotary and reciprocal components which both produce positive mechanical work.

Each component in the above described thermo-energetical cascade is designed and constructed for performance with the specific range of its operation. Thus only the reciprocator component is designed to withstand peak pressures. The rotary component and other auxiliary and intermediary components are specifically designed for their respective lower pressure operations.

While in the foregoing embodiment of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A regenerative thermal engine comprising:

an internal combustion apparatus including a cylinder, a piston reciprocally movable in the cylinder, the cylinder and piston defining in part a chamber for combustion, intake means for introducing air into the cylinder at predetermined intervals, exhaust means for removing combustion gases from the cylinder at predetermined intervals, and a regenerator liner lining the cylinder in at least a part of the chamber in which the piston is movable, the liner having a structure with surfaces defining a plurality of regenerative cells constructed to cyclically admit, hold and discharge compressed air from the cylinder for thermally insulating the cylinder from the heat of combustion, and the piston being incrementally spaced from the regenerator liner; and, means for maintaining the piston incrementally spaced from said regenerator liner during cycled operation of the engine, which means includes a dual crank and dual connecting rod mechanism connected to the piston and adapted to eliminate piston side thrust, the mechanism having two connecting rods connected to two counterrotating crank shafts, said mechanism being dynamically balanced wherein contact of the piston with the regenerator liner is prevented during operation of the engine.

2. The engine of claim 1 wherein said regenerative cells at least periodically communicate directly with said chamber.

3. The engine of claim 1 wherein a cyclic process of intake, compression, expansion, exhaust and scavenging specific to a piston engine actuates continuous cyclic movement of compressed air into and out of the regenerative cells whereby the compressed air is integrated into the regenerative cells and absorbs the heat radiated from all the hot structure of the liner whereby the enthalpic content of the compressed air is increased and released in the expansion stroke as recovered energy of a cooling process.

4. The engine of claim 2 wherein the regenerator liner lines the cylinder and the liner structure has a configuration including grooves that forms a labyrinth sealing system with the piston displaced a minimum increment from the structure of the regenerator liner.

5. The engine of claim 4 wherein the structure of the regenerator liner comprises a plurality of alternately parallel fins and grooves.

6. The engine of claim 5 wherein the plurality of alternating fins and grooves have an angled orientation, the cells formed thereby having circular openings around the cylinder, angled toward the direction of a piston compression stroke.

7. The engine of claim 6 wherein the grooves are constructed in depth and width and the fins proximally spaced from said piston to inhibit airflow from cell to cell, wherein pressure stratification is generated from the cells proximate the top of the piston stroke.

8. The engine of claim 5 wherein the grooves are constructed in depth, width and orientation wherein the outside radial movement of air during an expansion stroke of a piston is toward the chamber center producing a dynamic separation of the hot gases from the cylinder liner.

9. The engine of claim 4 in combination with means for injecting a liquid spray against the liner when the cells communicate with the chamber prior to or during a compression stroke of the piston wherein liquid spray is carried into the cells for vaporization cooling and expelled during an expansion stroke for added power generation.

10. The engine of claim 4 wherein the regenerator liner includes a cooling jacket means surrounding substantially the entire combustion chamber and defining thin spaces in which a cooling fluid can be heated by heat conducted from the combustion chamber, the thin spaces forming a helicoidal passageway being in continuous communication with the working space within the cylinder; and, injection means for injecting a prescribed amount of cooling fluid through the passageway into the thin spaces defined by the the cooling jacket means at a prescribed time during each complete cycle of the engine, such that the resulting cooling fluid film is heated to produce high pressure, superheated vapor for entry into the working space within the cylinder such that Rankine cycle is thereby provided.

11. The engine of claim 10, wherein the thin space defined by the cooling jacket means is a narrow spiral passageway beginning near the lower end of the combustion chamber and ending near the upper end of the combustion chamber.

12. The engine of claim 11, wherein the narrow spiral passageway defined by the cooling jacket means is in continuous communication with the engine cylinder via at least one injection port adjacent to the upper end of the cylinder.

13. The engine of claim 12, and further including means for recovering at least a portion of the cooling fluid from the exhaust gases and steam expelled from the engine during its exhaust cycle, the recovered cooling fluid being subsequently used by the injection means.

14. The engine of claim 1 wherein the cylinder is divided into at least three zones with a first combustion zone having the regenerator liner, a second port zone having air and gas ports and a third guide zone displaced from the first combustion zone by said intermediary port zone, wherein said means for maintaining the piston incrementally spaced from the liner includes a piston guide cylinder in said guide zone, said guide cylinder being of relatively cool temperature by its displacement from said combustion zone.

15. The engine of claim 14 wherein said piston has a differential configuration with a large diameter cap positioned for reciprocation in said first zone and a smaller diameter cross head positioned for reciprocation in said guide zone.

16. The engine of claim 4 wherein said engine includes a second piston which with said first piston forms a mechanism in permanent dynamic balance, constituted from two parallel side-by-side and synchronized reciprocating pistons, dynamically balance connecting rods and oppositely rotating crankshafts, in which the pistons are interconnected by a strap whereby the side thrusts are in continuous opposition, totally cancelling the side contact between the pistons and the cylinder, the mechanism being in permanent dynamic balance and associated with a common combustion chamber which produces an identical pressure evolution in both cylinders.

17. The engine of claim 10 wherein the thin spaces defined by the cooling jacket means surround a substantial portion of an upper wall of the engine cylinder.

18. The engine of claim 17 wherein:

the engine further includes a precombustion chamber located immediately above the upper end of the cylinder; and the thin spaces defined by the cooling jacket means further surround the precombustion chamber.

19. The engine of claim 18 wherein the cooling fluid injected by the injection means absorbs substantially all of the heat conducted away from the combustion working space, such that the internal combustion engine is an adiabatic system and is free of any additional means for dissipating heat conducted away from the cylinder working space and the system operates as internal cogeneration system.

20. The engine of claim 9 wherein the cooling fluid comprises a liquid from the group consisting of water, liquefied gases, liquid NO2, hydroamonia, and methanol.

21. The engine of claim 10 wherein the cooling fluid comprises a liquid from the group consisting of water, liquefied gases, liquid NO2, hydroamonia, and methanol.

22. The engine of claim 1, including a surface of the combustion chamber structured with ceramic.

* * * * *